US006508046B1

(12) United States Patent
Resterhouse et al.

(10) Patent No.: US 6,508,046 B1
(45) Date of Patent: Jan. 21, 2003

(54) SELF-ADJUSTING CAPPING CHUCK ASSEMBLY FOR FILLER AND/OR CAPPER DEVICE AND ASSOCIATED METHOD

(75) Inventors: Michael Resterhouse, Muskegon, MI (US); Randall Johnson, Grand Haven, MI (US); Robert Szabo, Allegan, MI (US); Jeffrey Persenaire, Hudsonville, MI (US); Terry Studabaker, Nunica, MI (US)

(73) Assignee: Fogg Filler Company, Holland, MI (US)

( * ) Notice: Subject to any disclaimer, the term of this patent is extended or adjusted under 35 U.S.C. 154(b) by 43 days.

(21) Appl. No.: 09/619,783

(22) Filed: Jul. 20, 2000

(51) Int. Cl.[7] ..... B65B 7/28

(52) U.S. Cl. ..... 53/331.5; 53/353; 53/356; 53/367

(58) Field of Search ..... 53/351, 353, 356, 53/485, 317, 331.5, 367

(56) References Cited

U.S. PATENT DOCUMENTS 880,406 A * 2/1908 Schmidt ..... 53/351
933,057 A * 9/1909 Brewington ..... 53/351
1,161,924 A * 11/1915 Cassady ..... 53/351
1,319,845 A * 10/1919 Buzatt ..... 53/331.5
1,754,461 A * 4/1930 Cundall ..... 53/331.5
1,773,259 A * 8/1930 Cundall ..... 53/331.5
2,409,899 A * 10/1946 Resina ..... 53/331.5
2,593,794 A * 4/1952 Resina ..... 53/331.5
3,262,247 A * 7/1966 Scholle ..... 53/331.5
3,597,896 A * 8/1971 Koll ..... 53/353
4,173,104 A * 11/1979 Koll ..... 53/351

* cited by examiner

*Primary Examiner*—John Sipos
(74) *Attorney, Agent, or Firm*—King & Jovanovic, PLC

(57) ABSTRACT

A self-adjusting capping chuck assembly for use in association with a filler and/or capper device comprising: an outer cam having an aperture defined by an inner peripheral geometry; and a cap engaging jaw displaced within the aperture of the outer cam. The cap engaging jaw includes at least two displaceable jaw components, and a member for biasing the displaceable jaw components into a cap engaging configuration.

11 Claims, 4 Drawing Sheets

SELF-ADJUSTING CAPPING CHUCK ASSEMBLY FOR FILLER AND/OR CAPPER DEVICE AND ASSOCIATED METHOD

BACKGROUND OF THE INVENTION

1. Field of the Invention

The present invention relates in general to a capping chuck assembly, and more particularly, to a self-adjusting capping chuck assembly, for use in association with a filler and/or capper device. The self-adjusting capping chuck assembly includes a cap engaging jaw that is readily displaceable and expandable in a plurality of vectors.

2. Background Art

Capping chuck assemblies for use in association with filler and/or capper devices have been known in the art for years. While capping chuck assemblies have become readily available for commercial applications, their inability to properly engage and secure a cap onto an aperture of a container remains problematic—especially when the capping chuck assembly is being used for capping plastic caps with varying peripheral dimensions and degrees of ovality and eccentricity.

In particular, it is not uncommon for a conventional capping chuck assembly to inadvertently drop a cap during use, which can leave a container uncapped and/or otherwise jam a component of the filler and/or capper device.

Additionally, inasmuch as conventional capping chuck assemblies do not adapt well to caps of varying dimension (which is often the case in large batch applications), a relatively high percentage of caps can be marred and/or the tamper band damaged during securement to a container. To be sure, marring of the cap and/or damage to the cap tamper band is extremely problematic because many of the capped containers are sold as end product in retail stores, where cleanliness and packaging integrity can greatly impact the sale of the particular good, such as a beverage or other grocery item.

Moreover, conventional capping chuck assemblies suffer from inadequate grip around the peripheral geometry of a cap, which can make the capping process highly inefficient and further damaging to the cap.

It is therefore an object of the present invention to provide a reliable capping chuck assembly for use in association with filler and/or capper devices which remedies the detriments and/or complications associated with conventional, non self-adjusting capping chuck assemblies known in the art.

These and other objects of the present invention will become apparent in light of the present specification, claims, and drawings.

SUMMARY OF THE INVENTION

The present invention is directed to a self-adjusting capping chuck assembly for use in association with a filler and/or capper device comprising: (1) an outer cam having an aperture defined by an inner peripheral geometry; and (2) a cap engaging jaw displaced within the aperture of the outer cam. The cap engaging jaw includes: (a) at least two displaceable jaw components; and (b) means for biasing the at least two displaceable jaw components into a cap engaging configuration.

In a preferred embodiment of the present invention, the cap engaging jaw includes between two and approximately ten displaceable jaw components.

In another preferred embodiment of the present invention, the biasing means comprises an elastomeric member, such as an o-ring, or alternatively, a coiled spring.

The present invention is also directed to a self-adjusting capping chuck assembly for use in association with a filler and/or capper device comprising: (1) an outer cam having an aperture defined by an inner peripheral geometry; (2) a cap engaging jaw displaced within the aperture of the outer cam; and (3) means for substantially reducing slipping and/or dropping of caps positioned within the cap engaging jaw assembly.

In accordance with the present invention, the self-adjusting capping chuck assembly, for use in association with a filler and/or capper device, may comprise: (1) a socket having an aperture, wherein the aperture is capable of receiving a cap ejection plug and an actuating pin; (2) a cap stop plate positioned within a lower shoulder of the socket; (3) a spacing plate emanating contiguously from the socket; (4) an outer cam emanating contiguously from the spacing plate, wherein the outer cam includes an aperture defined by an inner peripheral geometry; (5) a cap engaging jaw displaced within the aperture of the outer cam; and (6) a retaining plate emanating contiguously from the outer cam. The cap engaging jaw includes: (a) at least two displaceable jaw components; and (b) means for biasing the at least two displaceable jaw components into a cap engaging configuration.

The present invention is further directed to a process for using a self-adjusting capping chuck assembly associated with a filler and/or capper device comprising the steps of: (1) providing a capping chuck assembly including: (a) an outer cam having an aperture defined by an inner peripheral geometry; and (b) a cap engaging jaw displaced within the aperture of the outer cam, wherein the cap engaging jaw includes at least two displaceable jaw components and a biasing mechanism for biasing the at least two displaceable jaw components into a cap engaging configuration; (2) self-adjustingly receiving a cap within the cap engaging jaw of the capping chuck assembly; (3) applying the cap to an aperture of a container; (4) securing the cap to the container generally without slippage; and (5) releasing the capping chuck assembly from the cap.

BRIEF DESCRIPTION OF THE DRAWINGS

The invention will now be described with reference to the drawings wherein.

DETAILED DESCRIPTION OF THE INVENTION

Figure 1:
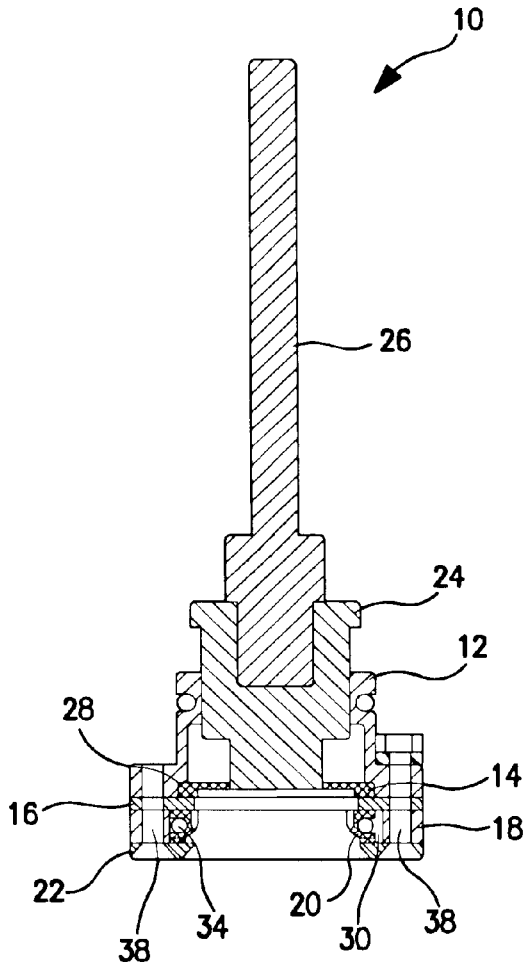
FIG. 1 of the drawings is a cross-sectional schematic representation of a capping chuck assembly fabricated in accordance with the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters. It will be further understood that the figures provided herein are merely schematic representations. As such, some of the components have been distorted from their actual scale for pictorial clarity.

Referring now to the drawings and to FIG. 1 in particular, a cross-sectional schematic representation of a first embodiment of capping chuck assembly 10 is shown, which generally comprises socket 12, cap stop plate 14, spacing plate 16, outer cam 18, cap engaging jaw 20, and retaining plate 22. As will be discussed in greater detail below, capping chuck assembly 10 includes a self-adjusting cap engaging jaw, which is readily displaceable and expandable in a plurality of vectors. Although not shown, capping chuck assembly 10 is primarily intended for use in association with a filler and/or capper device, which is capable of filling, and, in turn, capping associated containers and/or bags with any one of a number of materials in solid, liquid, and/or gaseous states.

Referring again to FIG. 1, socket 12 includes an aperture for accommodating cap ejection plug 24 and actuating pin 26. Cap ejection plug 24 and actuating pin 26 cooperate to facilitate the disengagement of capping chuck assembly 10 from an associated cap (not shown) during normal operation of the capping chuck assembly.

Cap stop plate 14 is positioned on shoulder 28 of socket 12, and serves to controllably regulate to degree of which a cap (not shown) is received into socket 12, and in turn, capping chuck assembly 10.

As is shown in FIG. 1, spacing plate 16 emanates contiguously from socket 12. Spacing plate 16 provides a gap between cap stop plate 14 and cap engaging jaw 20, so that at least a portion of a cap (not shown) may received past cap engaging jaw 20 to fully establish positive engagement of the cap.

Figure 2:
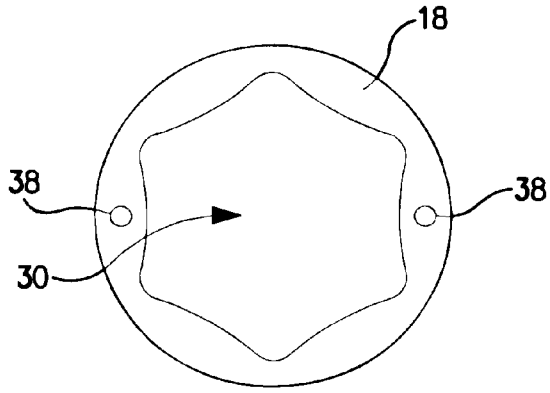
FIG. 2 of the drawings is a top plan schematic representation of an outer cam fabricated in accordance with the present invention.
Figure 3D:
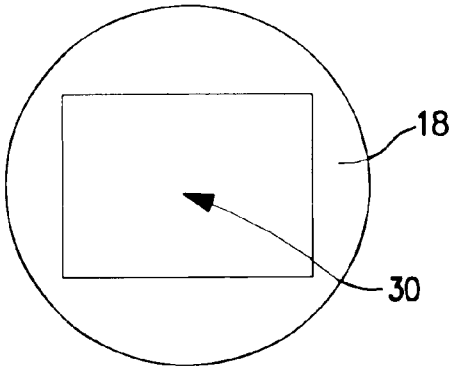
FIGS. 3*a*–3*f* of the drawings is a top plan schematic representation of multiple embodiments of outer cams fabricated in accordance with the present invention.
Figure 3C:
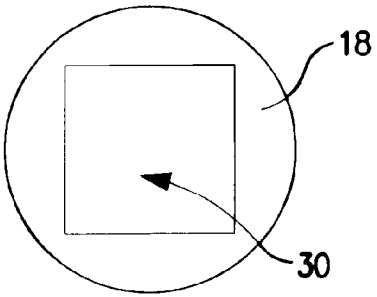
Figure 3B:
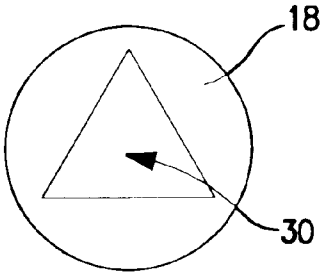
Figure 3A:
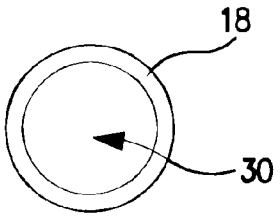
Figure 3F:
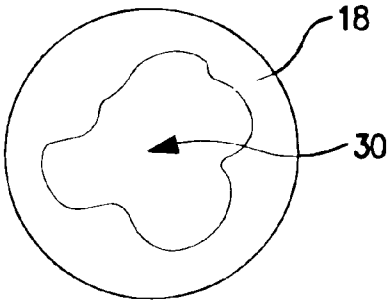
Figure 3E:
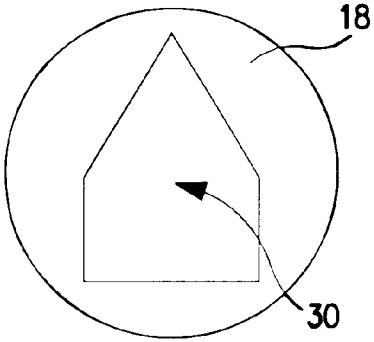

Outer cam 18 is juxtaposed to spacing plate 16 and retaining plate 22. As is best shown in FIG. 2, outer cam 18 includes an inner peripheral geometry which defines aperture 30. For purposes of the present disclosure outer cam 18 includes a generally circular outer peripheral geometry and a generally hexagonal inner peripheral geometry. However, it will be understood that numerous other geometric configurations for the inner and outer peripheral geometries of outer cam 18 are likewise contemplated for use, including substantially circular, substantially triangular, substantially square, substantially rectangular, substantially pentagonal, substantially hexagonal, substantially octagonal, substantially polygonal, and/or substantially arbitrary—examples of which are shown in FIG. 3. In cooperation with the dimensions of cap engaging jaw 20, outer cam 18 controllably regulates the degree of horizontal, vertical, and/or rotational displacement, which is sometimes referred to as the degree of "float" within aperture 30. In addition, outer cam 18 regulates the maximum degree of expansion of cap engaging jaw 20 (i.e. the cap engaging jaw may only expand as large as the aperture defined by the inner peripheral geometry of the outer cam).

Figure 4:
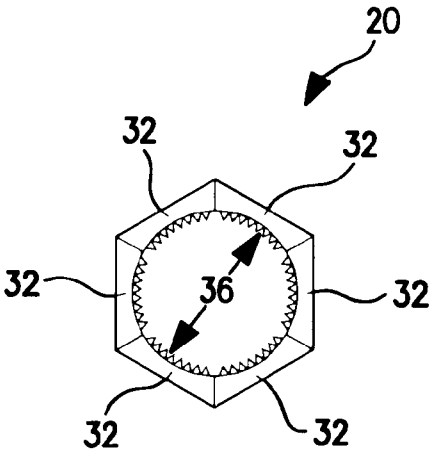
FIG. 4 of the drawings is a top plan schematic representation of a cap engaging jaw fabricated in accordance with the present invention.
Figure 5A:
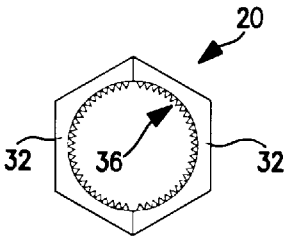
FIGS. 5*a*–5*i* of the drawings is a top plan schematic representation of multiple embodiments of cap engaging jaws fabricated in accordance with the present invention.
Figure 5B:
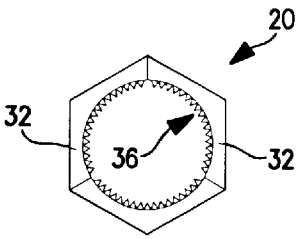
Figure 5C:
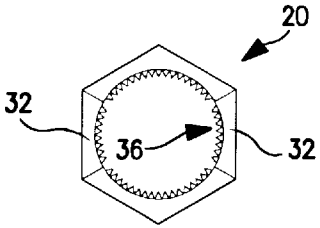
Figure 5D:
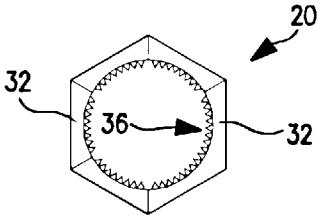
Figure 5E:
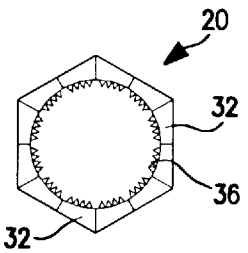
Figure 5F:
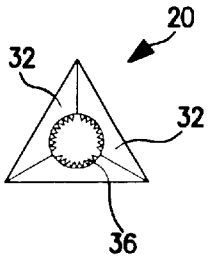
Figure 5G:
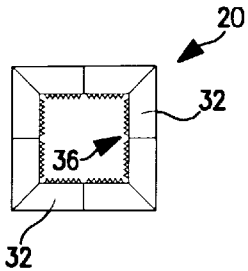
Figure 5H:
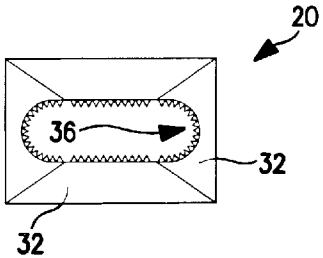
Figure 5I:
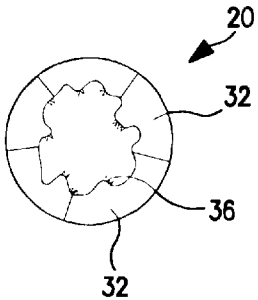

Referring to FIGS. 1 and 4, cap engaging jaw 20 is displaced within aperture 30 of outer cam 18. For purposes of the present disclosure, and as is shown in FIG. 4, cap engaging jaw 20 includes six displaceable jaw components 32. While cap engaging jaw 20 has been disclosed, for illustrative purposes only, as comprising six jaw components it is likewise contemplated that any one of a number of configurations are suitable for use in accordance the present invention—examples of which are shown in FIG. 5. Indeed, cap engaging jaw 20 preferably includes from approximately two to approximately ten jaw components 32.

Means 34 for biasing jaw components 32 inwardly and away from outer cam 18 are also provided which encourage jaw 20 into a cap engaging configuration (see FIG. 1). Again, for purposes of the present disclosure, biasing means 34 may include, for example, an elastomeric member, such as an o-ring, or alternatively, a coiled spring extending about the outside circumference of cap engaging jaw 20. A plurality of teeth 36 (see FIG. 4) or treads (not shown) are provided on each jaw component 32, to provide for additional gripping and/or securement to a cap (not shown).

As previously discussed, cap engaging jaw 20 is readily displaceable and expandable in a plurality of vectors (i.e. any one of the jaw components can move relative to the others and relative to outer cam 18), which in turn, enables capping chuck assembly 10 to be self-adjusting. The self-adjusting nature of the capping chuck assembly provides numerous benefits over conventional, non self-adjusting capping chuck assemblies. Specifically, cap engaging jaw 20 enables capping chuck assembly 10 to substantially reduce the number of caps dropped by the capping chuck during normal operation of filling and capping conventional containers, relative to a conventional capping chuck assembly without such a cap engaging jaw configuration. Such an improvement is realized due to, among other things, the float and expansion characteristics of cap engaging jaw 20, and the substantial independent relationship between jaw components. Furthermore, the float and expansion characteristics generously enable caps of varying dimensions to be properly positioned within the cap engaging jaw. Moreover, inasmuch as caps are positively engaged about their circumference and slippage is substantially precluded, marring of an associated cap and/or damage to tamper bands (which normally occurs when caps are poorly retained in the capping chuck) is substantially minimized relative to a conventional, non self-adjusting capping chuck assemblies.

Capping chuck assembly 10 can be assembled very simply by arranging the components in accordance with FIG. 1. Once arranged, a plurality of fasters (not shown), such as screws, can be fastenably inserted into apertures 38 to maintain an assembled capping chuck assembly. Of course, numerous other fastening mechanisms that would be known to those having ordinary skill in the art having the present disclosure before them are likewise contemplated for use.

For purposes of the present disclosure capping chuck assembly 10 can generally be fabricated from numerous materials, including metals, natural and synthetic resins and composites, carbonaceous materials, ceramics, etc.

Filler and/or capper devices having as a component part an above-identified self-adjusting capping chuck assembly can be used in a wide variety of filling and capping applications wherein, under normal operation, it is desirous to secure a cap to a container. Such caps include metal and plastic caps of varying size and geometry.

The present invention is also directed to a process for using a self-adjusting capping chuck assembly associated with a filler and/or capper device comprising the steps of: (1) providing a capping chuck assembly as is disclosed herein;

(2) self-adjustingly receiving a cap within the cap engaging jaw of the capping chuck assembly; (3) applying the cap to an aperture of a container; (4) securing the cap to the container generally without slippage; and (5) releasing the capping chuck assembly from the cap.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A capping chuck assembly for use in association with a capper device, comprising:

an outer cam having an aperture defined by an inner peripheral geometry; and a cap engaging jaw displaced within the aperture of the outer cam, wherein the cap engaging jaw is smaller than the aperture of the outer cam, the cap engaging jaw being partially rotatable and translatable within the aperture relative to the outer cam, to in turn, float within the aperture, and further wherein the cap engaging jaw includes:

at least two displaceable jaw components; and means for biasing the at least two displaceable jaw components into a cap engaging configuration, wherein the biasing means is positioned such that, in the absence of a cap, the at least two displaceable jaw components remain biased toward each other, and the insertion of a cap serves to overcome the biasing means, thereby moving at least one of the at least two displaceable jaw components away from at least one other of the at least two displaceable jaw components, whereupon rotation of the outer cam, rotates the cap engaging jaw having a cap therein, to, in turn, rotate a cap onto a container.

2. The capping chuck assembly according to claim 1, wherein the cap engaging jaw includes between two and approximately ten displaceable jaw components.

3. The capping chuck assembly according to claim 1, wherein the cap engaging jaw includes six displaceable jaw components.

4. The capping chuck assembly according to claim 1, wherein the biasing means comprises an elastomeric member.

5. The capping chuck assembly according to claim 4, wherein the biasing means comprises an o-ring.

6. The capping chuck assembly according to claim 1, wherein the biasing means comprises a coiled spring.

7. The capping chuck assembly according to claim 1, wherein the outer cam includes a hexagonal aperture.

8. The capping chuck assembly according to claim 7, wherein the cap engaging jaw includes a hexagonal outer peripheral geometry.

9. The capping chuck assembly according to claim 8, wherein the cap engaging jaw consists of six displaceable jaw components and an o-ring positioned around an outer peripheral geometry of the six jaw components.

10. The capping chuck assembly according to claim 1, wherein the cap engaging jaw includes a plurality of teeth on an inner surface of the at least two displaceable jaw components.

11. A capping chuck assembly for use in association with a capper device, comprising:

a socket having an aperture, wherein the aperture is capable of receiving a cap ejection plug and a driving pin;

a cap stop plate positioned within a lower shoulder of the socket;

a spacing plate emanating contiguously from the socket;

an outer cam emanating contiguously from the spacing plate, wherein the outer cam includes an aperture defined by an inner peripheral geometry;

a cap engaging jaw displaced within the aperture of the outer cam, wherein the cap engaging jaw is smaller than the aperture of the outer cam, the cap engaging jaw being partially rotatable and translatable within the aperture relative to the outer cam, to in turn, float within the aperture, and further wherein the cap engaging jaw includes:

at least two displaceable jaw components; and means for biasing the at least two displaceable jaw components into a cap engaging configuration, wherein the biasing means is positioned such that, in the absence of a cap, the at least two displaceable jaw components remain biased toward each other, and the insertion of a cap serves to overcome the biasing means, thereby moving at least one of the at least two displaceable jaw components away from at least one other of the at least two displaceable jaw components; and a retaining plate emanating contiguously from the outer cam, whereupon rotation of the outer cam, rotates the cap engaging jaw having a cap therein, to, in turn, rotate a cap onto a container.

* * * * *